United States Patent [19]

Masumoto et al.

[11] 4,244,754

[45] Jan. 13, 1981

[54] PROCESS FOR PRODUCING HIGH DAMPING CAPACITY ALLOY AND PRODUCT

[75] Inventors: Hakaru Masumoto; Showhachi Sawaya, both of Sendai, Japan

[73] Assignee: The Foundation: The Research Institute of Electric and Magnetic Alloys, Japan

[21] Appl. No.: 940,220

[22] Filed: Sep. 6, 1978

Related U.S. Application Data

[62] Division of Ser. No. 701,499, Jul. 1, 1976, abandoned.

[30] Foreign Application Priority Data

| | | | |
|---|---|---|---|
| Jul. 5, 1975 | [JP] | Japan | 50-82959 |
| Jul. 16, 1975 | [JP] | Japan | 50-86902 |
| Jul. 16, 1975 | [JP] | Japan | 50-86903 |

[51] Int. Cl.[3] ..... C21D 7/02

[52] U.S. Cl. ..... 148/12 R; 148/31

[58] Field of Search ..... 75/123 J, 134 F, 122, 75/126 C, 123 L; 148/12 R, 12.4, 31, 31.55

[56] References Cited

U.S. PATENT DOCUMENTS

| | | | |
|---|---|---|---|
| 3,147,158 | 9/1964 | Fiedler | 148/31.55 |
| 3,223,602 | 12/1965 | Warousek | 148/31.55 |
| 3,287,184 | 11/1966 | Koh | 148/31.55 |
| 3,682,717 | 8/1972 | Sasaki et al. | 148/37 |
| 3,719,475 | 3/1973 | Habraken et al. | 75/126 D |
| 3,746,586 | 7/1973 | Buchanan et al. | 75/126 D |
| 3,929,522 | 12/1975 | Salsgiver et al. | 75/123 L |
| 3,959,033 | 5/1976 | Barisoni et al. | 148/31.55 |
| 4,046,602 | 9/1977 | Stanley | 75/123 L |
| 4,065,330 | 12/1977 | Masumoto et al. | 148/31.55 |
| 4,066,479 | 1/1978 | Shimoyama et al. | 148/31.55 |

*Primary Examiner*—R. Dean

*Attorney, Agent, or Firm*—Hill, Van Santen, Steadman, Chiara & Simpson

[57] ABSTRACT

A method for producing a high damping capacity alloy comprising 0.1–10% by weight of at least one of W, Si and Ti and the remainder of Fe and, further comprising 0.01–45% in total, as a subingredient, of at least one of Cr, Al, Sb, Nb, V, Ta, Sn, Zn, Zr, Cd, Gd, Ga, P, Au, Ag, Ge, Sm, Se, Ce, La, Bi, Pt, Pd, Be, Mg, Re, Rh, Y, Pb, As, B, Eu and S, comprising the steps of (1) melting said starting material, (2) shaping the product into a desired form, (3) heating the thus formed article at a high temperature between its melting point and 800° C. for more than 1 minute to 100 hours, and (4) cooling the article at a suitable cooling rate of 1° C./second to 1°0 C./hour, so as to have a high damping capacity of more than $2\times10^{-3}$ and high cold workability over wide temperature range and a heat-treated high damping capacity alloy thereof.

6 Claims, 9 Drawing Figures

PROCESS FOR PRODUCING HIGH DAMPING CAPACITY ALLOY AND PRODUCT

This is a division of application Ser. No. 701,499, filed July 1, 1976, abandoned.

BACKGROUND OF THE INVENTION (1) Field of the Invention

The present invention relates to a high damping capacity alloy having high damping capacity of more than about $2\times10^{-3}$ over a wide temperature range and more particularly to a high vibration damping capacity alloy having good cold workability and high corrosion resistance.

(2) Description of the Prior Art

Recently, elements or members made of alloys having damping capacities have been widely used in precision instruments susceptible to vibrations, and machines such as aircraft, ships, vehicles and the like causing vibrations and noises for the purpose of mitigating the public nuisance resulting from the vibrations and noises.

In the prior art, alloys of Mn-Cu, Ni-Ti, Zn-Al, etc. having values of $Q^{-1}$ more than 0.005 have been commonly used. The value of $Q^{-1}$ indicates the inherent damping capacity of the alloy against vibration and can be expressed by the following equation:

$$Q^{-1}=\delta/\pi$$

where $\delta$ is logarithmic decrement. In other words, $Q^{-1}$ is a function of the energy decreased during one cycle. The larger value of $Q^{-1}$ decreases much more energy of the vibration so that the amplitude becomes smaller in a shorter period of time to exhibit a higher damping effect.

The alloys of Mn-Cu and Ni-Ti among the damping alloys of the prior art are superior in the damping capacity characteristics at room temperature to that of other alloy. However, as the temperature becomes higher, the damping capacity decreases rapidly and becomes substantially zero at the temperature near 100° C. such that the alloys cannot be distinguishable in damping capacity from normal metals at that temperature. Accordingly, such alloys do not exhibit any damping capacity at a temperature higher than 100° C. On the other hand, alloys of Zn-Al of the prior art have a high damping capacity at temperatures higher than 100° C. However, as the temperature becomes lower, the damping capacity decreases rapidly and becomes a very small value at room temperature. These alloys of Mn-Cu, Ni-Ti and Zn-Al are poor in cold workability and corrosion resistance.

Accordingly, it has been expected to provide a damping alloy having a high damping capacity, high cold workability and high corrosion resistance over wide range of temperature.

SUMMARY OF THE INVENTION

A principle object of the invention is, therefore, to provide an improved high damping capacity alloy having high damping capacity, high cold workability and high corrosion resistance over a wide temperature range.

To accomplish the above object the alloy according to the invention comprises 0.1–10% by weight of at least one of tungsten, silicon and titanium, and the remainder of iron and has a damping capacity of more than about $2\times10^{-3}$ against vibration by a suitable heat-treatment.

In a second aspect of the invention the alloy comprises 0.1–10% by weight of at least one of tungsten, silicon and titanium, 0.1–45% by weight of chromium and the remainder of iron and has a damping capacity of more than about $2\times10^{-3}$ against vibration by a suitable heat-treatment.

In a third aspect of the invention the alloy comprises 0.1–10% by weight of at least one of tungsten, silicon and titanium as a main component and 0.01–45 weight % in total of additional component of at least one element selected from the group consisting of less than 45 weight % of chromium, less than 10 weight % of aluminum, nickel, manganese, antimony, niobium, vanadium and tantalum, less than 5 weight % of tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, less than 1 weight % of lead, carbon, arsenic and boron, and less than 0.5 weight % of europium and sulfur, and the remainder of iron and has a damping capacity of more than about $2\times10^{-3}$ against vibration by a suitable heat-treatment.

In a fourth aspect of the invention the alloy comprises 0.1–10% by weight of at least one of tungsten, silicon and titanium and 0.1–45% by weight of chromium as main components and 0.01–45 weight % in total of additional component of at least one element selected from the group consisting of less than 10 weight % of aluminum, nickel, manganese, antimony, niobium, vanadium and tantalum, less than 5 weight % of tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, less than 1 weight % of lead, carbon, arsenic and boron, and less than 0.5 weight % of europium and sulfur, and the remainder of iron and has a damping capacity of more than about $2\times10^{-3}$ against vibration by a suitable heat-treatment.

Another objects and advantages of the invention will become more apparent as the description proceeds, when considered with the example and accompanying drawings.

DESCRIPTION OF THE PREFERRED EMBODIMENTS

Figure 1A:
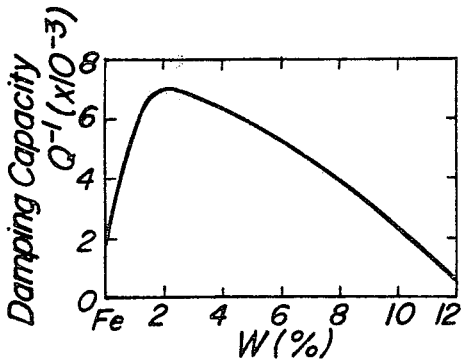
FIGS. 1*a*, 1*b* and 1*c* are graphical representations of a relationship between the composition and damping capacity of the alloys of Fe-W, Fe-Si and Fe-Ti according to the invention under annealed condition, respectively.

According to the invention, a starting material consisting of 0.1–10% by weight of W, Si and Ti and/or 0.1–45% by weight of Cr, and the remainder of Fe is melted in air or inert gas or in vacuum in a conventional blast furnace. The starting material may have 0.01–45% in total of at least one additional component selected from the group consisting of less than 10% of Al, Ni, Mn, Sb, Nb, V and/or Ta, less than 5% of Sn, Zn, Zr, Cd, Gd, Ga, P, Au, Ag, Ge, Sm, Se, Ce, La, Bi, Pt, Pd, Be, Mg, Re, Rh and/or Y, less than 1% of Pb, C, As and/or B, and less than 0.5% of Eu and/or S. Then melt is added with a small amount (less than about 1%) of manganese, silicon, titanium, aluminum, calcium and the like to remove undesirable impurities and thereafter sufficiently stirred to produce a molten alloy uniform in composition. Thus, the produced alloy is subjected to forging, rolling or swaging at room temperature or a temperature lower than 1,300° C. to shape a blank material suitable for its application.

According to the invention the shaped article of the alloy is further subjected to the following treatments.

(A) After the article has been heated at a temperature of not more than its melting point and not less than 500° C. for more than one minute and less than 100 hours, preferably 5 minutes to 50 hours, it is quenched by the cooling speed quicker than 1° C./sec (such as 1° C./sec–2,000° C./sec) or annealed by slow cooling at a rate of between 1° C./sec and 1° C./hour for the purpose of solution treatment.

(B) The formed article is cold worked after the above heat treatment of quenching or annealing.

(C) After the above heat treatment of quenching of the step (A) or cold working of the step (B), the formed article is heated at a temperature between 100° C. and lower than the temperature for the quenching (i.e. 800°–1,600° C.) for more than one minute to 100 hours, preferably 5 minutes to 50 hours and then cooled at a rate of slow cooling speed between 1° C./sec and 1° C./hour selected from the composition of alloy.

In the above homogenizing solution treatment, the time of one minute to 100 hours for heating the blank depends upon the weight of the blank to be treated, the temperature at which it is heated and the composition thereof. In other words, a material having a high melting point such as 1,600° C. may be heated approximately at 1,600° C., so that the time for heating at that temperature may be short, for example, 1–5 minutes. On the other hand, when the heating is effected at a temperature near the lower limit of 800° C., a long period of time such as 100 hours is necessary for the heating.

The heating time may be widely selected depending on the wide range of the material, weight or massiveness from 1 gram as in a laboratory scale to 1 ton as in a factory scale. In comparison at the same temperature, a small size of material only requires 1 minute to 5 hours for the solution treatment, while a large size of material requires 10–100 hours for the treatment.

If the heating for the solution treatment is satisfactorily effected, the cooling speed can be selected within a very wide range from the quick cooling quicker than 1° C./sec such as 1° C./sec to 2,000° C./sec to the slow cooling such as 1° C./sec–1° C./hr. Such an allowance of selection of the cooling speed depends upon whether the heating for the solution treatment is satisfactorily completed. If the solution treatment is incomplete, the tensile strength and damping capacity of the article are considerably lower and also the production yield is poor.

In the cold working of the step (B), the tensile strength is improved, but the damping capacity is somewhat lowered due to the presence of residual strain. However, if the working ratio is sufficiently small, the residual strain is not greatly caused, so that the tensile strength can be increased without particularly lowering the damping capacity.

On the other hand, if the working ratio is large, the worked article is subjected to a heat treatment in the subsequent step (C), whereby the homoginized stable structure is obtained, so that the damping capacity is substantially restored to the initial value.

Moreover, by heat-treating the article after the homoginizing solution treatment in the step (C), the tensile strength is improved without substantially lowering the damping capacity.

The invention will be explained with reference to the following Examples.

EXAMPLE 1

A mixture of total weight of about 500 grams having the composition of Fe and W as shown in Table 1 was melted in an alumina crucible in a high-frequency induction furnace in an atmosphere of argon gas. After stirring the melt, it was poured into a mold to obtain an ingot having a square section of 35×35 mm. The ingot was then forged into a rod having a 10 mm diameter circular section. The rod was annealed at 1,000° C. for one hour. Then the rod was drawn at room temperature to form a wire of 0.5 mm diameter which was then cut into a plurality of wires having suitable lengths. These wires were heated at 1,000° C. for one hour and cooled at a rate of 100° C. per hour to provide test pieces for measuring the damping capacity by the torsion pendulum method and the tensile strength. Table 1 illustrates the results of the test. It is understood that the alloy according to the invention has a remarkably higher damping capacity (higher by the factor of several tens) than that $Q^{-1}=0.1(\times 10^{-3})$ of the conventional steel constianing 0.1% carbon.

TABLE 1

| Composition | | Damping capacity $Q^{-1}$ ($\times 10^{-3}$) | | | | | | Tensile strength (Kg/mm$^2$, 20° C.) |
|---|---|---|---|---|---|---|---|---|
| | | 0° C. | 50° C. | 100° C. | 200° C. | 300° C. | 400° C. | |
| Fe(%) | W(%) | Annealed condition by cooling at a rate of 100° C./hr after heated at 1,000° C. for one hour | | | | | | |
| 99.0 | 1.0 | 5.4 | 5.2 | 5.2 | 5.5 | 6.0 | 6.8 | 38 |
| 97.0 | 3.0 | 6,9 | 6.4 | 6.5 | 7.0 | 8.2 | 9.0 | 40 |
| | | 96% cold worked condition after annealed | | | | | | |
| 99.0 | 1.0 | 4.1 | 4.0 | 4.0 | 4.3 | 4.6 | 5.1 | 45 |
| 97.0 | 3.0 | 4.8 | 4.7 | 4.7 | 4.9 | 5.2 | 5.5 | 53 |
| | | Water quenched condition after heated at 1,000° C. for one hour | | | | | | |
| 99.0 | 1.0 | 4.7 | 4.7 | 4.8 | 5.1 | 4.7 | 6.1 | 42 |

TABLE 1-continued

| Composition | | Damping capacity $Q^{-1}$ ($\times 10^{-3}$) 0° C. | 50° C. | 100° C. | 200° C. | 300° C. | 400° C. | Tensile strength (Kg/mm$^2$, 20° C.) |
|---|---|---|---|---|---|---|---|---|
| 97.0 | 3.0 | 5.4 | 5.3 | 5.5 | 6.0 | 6.4 | 7.1 | 50 |

EXAMPLE 2

A mixture of total weight of about 500 grams having the composition of Fe and Si as shown in Table 2 was melted in an alumina crucible in a high-freqency induction furnace in an atmosphere of argon gas. After stirring the melt, it was poured into a mold to obtain an ingot having a square section of 35×35 mm. The ingot was then forged into a rod having a 10 mm diameter circular section. The rod was annealed at 1,000° C. for one hour. Then the rod was drawn at room temperature to form a wire of 0.5 mm diameter which was then cut into a plurality of wires having suitable lengths. These wires were heated at 1,000° C. for one hour and cooled at a rate of 100° C. per hour to provide test pieces for measuring the damping capacity by the torsion pendulum method and the tensile strength. Table 2 illustrates the results of the test. It is understood that the alloy according to the invention has a remarkably higher damping capacity (higher by the factor of several tens) than that $Q^{-1}=0.1(\times 10^{-3})$ of the conventional steel containing 0.1% carbon.

TABLE 2

| Composition | | Damping capacity $Q^{-1}$ ($\times 10^{-3}$) 0° C. | 50° C. | 100° C. | 200° C. | 300° C. | 400° C. | Tensile strength (Kg/mm$^2$, 20° C.) |
|---|---|---|---|---|---|---|---|---|
| Fe(%) | Si(%) | Annealed condition by cooling at a rate of 100° C./hr after heated at 1,000° C. for one hour | | | | | | |
| 99.0 | 1.0 | 7.2 | 7.2 | 7.2 | 8.5 | 9.2 | 9.5 | 38.0 |
| 97.0 | 3.0 | 8.8 | 8.8 | 9.0 | 9.5 | 10.5 | 10.9 | 39.0 |
| | | 96% cold worked condition after annealed | | | | | | |
| 99.0 | 1.0 | 5.6 | 5.6 | 5.6 | 5.9 | 6.5 | 7.0 | 53.5 |
| 97.0 | 3.0 | 6.4 | 6.4 | 6.4 | 7.0 | 7.5 | 8.0 | 55.8 |
| | | Water quenched condition after heated at 1,000° C. for one hour | | | | | | |
| 99.0 | 1.0 | 6.1 | 6.1 | 6.2 | 6.5 | 7.0 | 7.4 | 50.4 |
| 97.0 | 3.0 | 6.5 | 6.5 | 6.5 | 6.8 | 7.4 | 8.0 | 50.6 |

EXAMPLE 3

A mixture of total weight of about 500 grams having the composition of Fe and Ti as shown in Table 3 was melted in an alumina crucible in a high-frequency induction furnace in an atmosphere of argon gas. After stirring the melt, it was poured into a mold to obtain an ingot having a square section of 35×35 mm. The ingot was then forged into a rod having a 10 mm diameter circular section. The rod was annealed at 1,000° C. for one hour. Then the rod was drawn at room temperature to form a wire of 0.5 mm diameter which was then cut into a plurality of wires having suitable lengths. These wires were heated at 1,000° C. for one hour and cooled at a rate of 100° C. per hour to provide test pieces for measuring the damping capacity by the torsion pendulum method and the tensile strength. Table 3 illustrates the results of the test. It is understood that the alloy according to the invention has a remarkably higher damping capacity (higher by the factor of several tens) than that $Q^{-1}=0.1(\times 10^{-3})$ of the conventional steel containing 0.1% carbon.

TABLE 3

| Composition | | Damping capacity $Q^{-1}$ ($\times 10^{-3}$) 0° C. | 50° C. | 100° C. | 200° C. | 300° C. | 400° C. | Tensile strength (Kg/mm$^2$, 20° C.) |
|---|---|---|---|---|---|---|---|---|
| Fe (%) | Ti (%) | Annealed condition by cooling at a rate of 100° C./hr after heated at 1,000° C. for one hour | | | | | | |
| 99.0 | 1.0 | 9.0 | 9.0 | 9.0 | 9.0 | 9.0 | 11.0 | 37.5 |
| 97.0 | 3.0 | 5.5 | 5.5 | 5.5 | 5.8 | 6.2 | 8.2 | 38.6 |
| | | 96% cold worked condition after annealed | | | | | | |
| 99.0 | 1.0 | 5.8 | 5.8 | 5.8 | 5.9 | 6.0 | 6.2 | 50.5 |
| 97.0 | 3.0 | 4.6 | 4.6 | 4.6 | 4.7 | 4.9 | 5.2 | 52.5 |
| | | Water quenched condition after heated at 1,000° C. for one hour | | | | | | |
| 99.0 | 1.0 | 6.2 | 6.2 | 6.2 | 6.4 | 6.5 | 6.8 | 49.7 |
| 97.0 | 3.0 | 4.8 | 4.8 | 4.8 | 4.8 | 5.0 | 5.5 | 49.9 |

Tables 4–13 show the damping capacities and tensile strengths of the typical alloys according to the invention.

TABLE 4(a)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | W (%) | Added elements (%) | | Annealed condition by cooling at a rate of 100° C./hr after heated at 1,000° C. for one hour | | | | | | |
| 79.0 | 1.0 | Cr | 20.0 | 25.0 | 25.0 | 25.0 | 25.7 | 26.4 | 27.5 | 55.0 |
| 94.0 | " | Al | 5.0 | 13.2 | 13.2 | 13.6 | 13.7 | 14.0 | 14.5 | 40.0 |
| " | " | Ni | " | 5.8 | 5.8 | 5.8 | 5.9 | 6.0 | 6.5 | 50.5 |
| " | " | Mn | " | 5.7 | 5.7 | 5.8 | 5.9 | 6.0 | 6.2 | 43.0 |
| " | " | Sb | " | 5.3 | 5.4 | 5.4 | 5.6 | 5.7 | 6.0 | 40.0 |
| " | " | Nb | " | 7.4 | 7.5 | 7.6 | 7.7 | 7.8 | 8.0 | 49.5 |
| " | " | Ti | " | 8.5 | 8.6 | 8.8 | 8.9 | 9.0 | 10.0 | 48.0 |
| " | " | V | " | 8.6 | 8.7 | 8.8 | 8.9 | 9.0 | 9.6 | 50.3 |
| " | " | Ta | " | 7.9 | 7.9 | 8.0 | 8.2 | 8.5 | 8.8 | 52.0 |
| " | " | Si | " | 9.9 | 9.9 | 10.2 | 10.4 | 10.5 | 10.9 | 53.2 |
| 96.5 | " | Sn | 2.5 | 8.5 | 8.6 | 8.5 | 8.7 | 8.8 | 9.0 | 50.0 |
| " | " | Zn | " | 7.6 | 7.7 | 7.8 | 7.9 | 7.9 | 8.0 | 40.4 |
| " | " | Zr | " | 6.3 | 6.3 | 6.4 | 6.5 | 6.6 | 6.9 | 39.9 |
| " | " | Cd | " | 5.2 | 5.3 | 5.4 | 5.5 | 5.6 | 5.8 | 38.0 |
| " | " | Gd | " | 5.3 | 5.3 | 5.4 | 5.6 | 5.7 | 5.8 | 38.7 |
| " | " | Ga | " | 6.4 | 6.4 | 6.5 | 6.6 | 6.8 | 7.0 | 37.5 |
| " | " | P | " | 6.6 | 6.6 | 6.7 | 6.8 | 6.9 | 7.4 | 39.0 |
| " | " | Au | " | 7.3 | 7.3 | 7.4 | 7.6 | 7.8 | 8.1 | 40.3 |
| " | " | Ag | " | 7.5 | 7.6 | 7.7 | 7.8 | 8.0 | 8.3 | 41.1 |
| " | " | Ge | " | 4.3 | 4.3 | 4.3 | 4.4 | 4.6 | 4.8 | 38.8 |
| " | " | Sm | " | 5.5 | 5.5 | 5.5 | 5.7 | 5.9 | 6.3 | 39.5 |
| " | " | Se | " | 6.6 | 6.6 | 6.7 | 6.9 | 7.3 | 7.5 | 40.0 |
| " | " | Ce | " | 5.3 | 5.3 | 5.4 | 5.5 | 5.6 | 5.8 | 39.0 |

TABLE 4(b)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | W (%) | Added elements (%) | | Annealed condition by cooling at a rate of 100° C./hr after heated at 1,000° C. for one hour | | | | | | |
| 96.5 | 1.0 | La | 2.5 | 6.2 | 6.2 | 6.3 | 6.5 | 6.6 | 6.8 | 40.3 |
| " | " | Bi | " | 5.4 | 5.4 | 5.6 | 5.7 | 5.8 | 5.9 | 40.3 |
| " | " | Pt | " | 6.4 | 6.5 | 6.6 | 6.8 | 6.9 | 7.5 | 45.5 |
| " | " | Pd | " | 8.3 | 8.3 | 8.4 | 8.5 | 8.7 | 8.9 | 43.2 |
| " | " | Be | " | 5.6 | 5.6 | 5.6 | 5.7 | 5.8 | 6.0 | 50.0 |
| " | " | Mg | " | 8.0 | 8.0 | 8.3 | 8.5 | 8.7 | 8.8 | 40.3 |
| " | " | Re | " | 7.7 | 7.7 | 7.8 | 7.9 | 8.9 | 8.5 | 38.8 |
| " | " | Rh | " | 6.6 | 6.7 | 6.8 | 6.9 | 7.3 | 7.5 | 35.5 |
| " | " | Y | " | 5.5 | 5.4 | 5.5 | 5.7 | 5.9 | 6.4 | 41.0 |
| 98.5 | " | Pb | 0.5 | 6.6 | 6.5 | 6.5 | 6.5 | 6.6 | 6.3 | 39.9 |
| " | " | C | " | 5.3 | 5.3 | 5.4 | 5.6 | 5.9 | 6.0 | 40.6 |
| " | " | As | " | 4.3 | 4.4 | 4.5 | 4.6 | 4.3 | 4.4 | 40.3 |
| " | " | B | " | 5.2 | 5.2 | 5.3 | 5.4 | 5.6 | 5.7 | 55.0 |
| 98.8 | " | Eu | 0.2 | 4.2 | 4.2 | 4.3 | 4.4 | 4.5 | 4.6 | 44.0 |
| " | " | S | " | 5.2 | 5.3 | 5.4 | 5.5 | 5.6 | 5.7 | 43.0 |

TABLE 5(a)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | W (%) | Added elements (%) | | 96% cold worked condition after annealed | | | | | | |
| 79.0 | 1.0 | Cr | 20.0 | 13.0 | 13.0 | 13.0 | 13.4 | 13.5 | 13.7 | 64.0 |
| 94.0 | " | Al | 5.0 | 7.7 | 7.7 | 7.8 | 7.9 | 8.0 | 8.3 | 52.0 |
| " | " | Ni | " | 4.5 | 4.6 | 4.6 | 4.6 | 4.7 | 4.8 | 54.5 |
| " | " | Mn | " | 4.4 | 4.4 | 4.4 | 4.5 | 4.6 | 4.7 | 55.0 |
| " | " | Sb | " | 3.8 | 3.8 | 3.8 | 3.8 | 3.9 | 4.0 | 50.0 |
| " | " | Nb | " | 5.6 | 5.6 | 5.6 | 5.7 | 6.0 | 6.3 | 58.0 |
| " | " | Ti | " | 6.3 | 6.3 | 6.3 | 6.3 | 6.4 | 6.3 | 57.0 |
| " | " | V | " | 6.2 | 6.2 | 6.3 | 6.4 | 6.5 | 6.7 | 60.0 |
| " | " | Ta | " | 5.7 | 5.7 | 5.7 | 5.8 | 5.9 | 5.9 | 61.0 |

TABLE 5(a)-continued

| Composition | | | | Damping capacity $Q^{-1}$ ($\times 10^{-3}$) | | | | | | Tensile strength (Kg/mm$^2$, |
|---|---|---|---|---|---|---|---|---|---|---|
| | | | | 0° C. | 50° C. | 100° C. | 200° C. | 300° C. | 400° C. | 20° C.) |
| Fe (%) | W (%) | Added elements | (%) | 96% cold worked condition after annealed | | | | | | |
| " | " | Si | " | 7.6 | 7.6 | 7.6 | 7.7 | 7.9 | 8.0 | 59.0 |
| 96.5 | " | Sn | 2.5 | 6.3 | 6.3 | 6.4 | 6.5 | 6.6 | 6.8 | 58.0 |
| " | " | Zn | " | 5.2 | 5.2 | 5.3 | 5.4 | 5.5 | 5.7 | 49.4 |
| " | " | Zr | " | 4.3 | 4.3 | 4.4 | 4.2 | 4.3 | 4.5 | 49.0 |
| " | " | Cd | " | 3.2 | 3.3 | 3.4 | 3.5 | 3.6 | 3.7 | 47.0 |
| " | " | Gd | " | 3.1 | 3.1 | 3.1 | 3.2 | 3.2 | 3.4 | 49.5 |
| " | " | Ga | " | 3.4 | 3.4 | 3.4 | 3.5 | 3.6 | 3.7 | 48.0 |
| " | " | P | " | 3.6 | 3.6 | 3.6 | 3.7 | 3.7 | 3.9 | 40.1 |
| " | " | Au | " | 4.2 | 4.2 | 4.3 | 4.3 | 4.5 | 4.6 | 48.4 |
| " | " | Ag | " | 5.1 | 5.1 | 5.2 | 5.2 | 5.3 | 5.4 | 52.0 |
| " | " | Ge | " | 3.8 | 3.8 | 3.8 | 3.9 | 4.0 | 4.2 | 47.7 |
| " | " | Sm | " | 3.2 | 3.2 | 3.2 | 3.4 | 3.6 | 3.7 | 49.0 |
| " | " | Se | " | 4.1 | 4.2 | 4.2 | 4.3 | 4.4 | 4.5 | 51.0 |
| " | " | Ce | " | 3.3 | 3.3 | 3.4 | 3.4 | 3.4 | 3.5 | 47.6 |

TABLE 5(b)

| Composition | | | | Damping capacity $Q^{-1}$ ($\times 10^{-3}$) | | | | | | Tensile strength (Kg/mm$^2$, |
|---|---|---|---|---|---|---|---|---|---|---|
| | | | | 0° C. | 50° C. | 100° C. | 200° C. | 300° C. | 400° C. | 20° C.) |
| Fe (%) | W (%) | Added elements | (%) | 96% cold worked condition after annealed | | | | | | |
| 96.5 | 1.o0 | La | 2.5 | 3.6 | 3.6 | 3.6 | 3.6 | 3.7 | 3.8 | 49.9 |
| " | " | Bi | " | 3.7 | 3.7 | 3.8 | 3.9 | 4.0 | 4.0 | 48.5 |
| " | " | Pt | " | 4.0 | 4.0 | 4.0 | 4.0 | 4.2 | 4.3 | 55.0 |
| " | " | Pd | " | 4.3 | 4.4 | 4.5 | 4.5 | 4.6 | 4.7 | 52.2 |
| " | " | Be | " | 3.6 | 3.6 | 3.7 | 3.7 | 3.8 | 3.9 | 58.6 |
| " | " | Mg | " | 4.5 | 4.5 | 4.6 | 4.7 | 4.8 | 4.9 | 48.3 |
| " | " | Re | " | 5.2 | 5.2 | 5.3 | 5.4 | 5.5 | 6.0 | 49.9 |
| " | " | Rh | " | 4.7 | 4.7 | 4.8 | 4.8 | 4.9 | 5.0 | 46.0 |
| " | " | Y | " | 4.4 | 4.3 | 4.2 | 4.2 | 4.5 | 4.6 | 48.0 |
| 98.5 | " | Pb | 0.5 | 4.0 | 4.0 | 4.3 | 4.2 | 4.1 | 4.3 | 49.0 |
| " | " | C | " | 3.2 | 3.2 | 3.2 | 3.5 | 3.6 | 3.7 | 50.3 |
| " | " | As | " | 3.1 | 3.1 | 3.2 | 3.3 | 3.4 | 3.5 | 51.0 |
| " | " | B | " | 3.0 | 3.0 | 3.0 | 3.2 | 3.5 | 3.6 | 63.0 |
| 98.8 | " | Eu | 0.2 | 4.2 | 4.2 | 4.3 | 4.3 | 4.2 | 4.3 | 56.0 |
| " | " | S | " | 3.2 | 3.1 | 3.1 | 3.2 | 3.3 | 3.4 | 52.0 |

TABLE 6(a)

| Composition | | | | Damping capacity $Q^{-1}$ ($\times 10^{-3}$) | | | | | | Tensile strength (Kg/mm$^2$, |
|---|---|---|---|---|---|---|---|---|---|---|
| | | | | 0° C. | 50° C. | 100° C. | 200° C. | 300° C. | 400° C. | 20° C.) |
| Fe (%) | W (%) | Added elements | (%) | Water quenched condition after heated at 1,000° C. for one hour | | | | | | |
| 79.0 | 1.0 | Cr | 20.0 | 14.3 | 14.3 | 14.4 | 14.6 | 14.7 | 15.0 | 59.0 |
| 94.0 | " | Al | 5.0 | 7.9 | 7.9 | 8.0 | 8.2 | 8.3 | 8.5 | 48.0 |
| " | " | Ni | " | 5.1 | 5.1 | 5.2 | 5.4 | 5.6 | 5.7 | 50.3 |
| " | " | Mn | " | 5.5 | 5.5 | 5.6 | 5.7 | 5.8 | 5.9 | 50.2 |
| " | " | Sb | " | 4.1 | 4.1 | 4.2 | 4.3 | 4.4 | 4.5 | 45.2 |
| " | " | Nb | " | 5.7 | 5.8 | 5.9 | 5.9 | 5.9 | 6.0 | 55.0 |
| " | " | Ti | " | 6.8 | 6.8 | 6.9 | 7.2 | 7.6 | 53.0 | |
| " | " | V | " | 6.5 | 6.5 | 6.6 | 6.7 | 6.8 | 6.9 | 54.0 |
| " | " | Ta | " | 5.9 | 5.9 | 5.9 | 6.1 | 6.3 | 6.5 | 55.0 |
| " | " | Si | " | 8.0 | 8.0 | 8.0 | 8.2 | 8.4 | 8.7 | 54.0 |
| 96.5 | " | Sn | 2.5 | 6.6 | 6.7 | 6.7 | 6.8 | 6.9 | 7.0 | 54.5 |
| " | " | Zn | " | 5.5 | 5.5 | 5.6 | 5.7 | 5.8 | 6.0 | 45.4 |
| " | " | Zr | " | 4.5 | 4.5 | 4.5 | 4.6 | 4.7 | 5.0 | 44.0 |
| " | " | Cd | " | 4.0 | 4.0 | 4.2 | 4.3 | 4.5 | 4.6 | 43.2 |
| " | " | Gd | " | 3.5 | 3.6 | 3.6 | 3.7 | 3.8 | 4.0 | 45.3 |
| " | " | Ga | " | 3.5 | 3.5 | 3.5 | 3.7 | 3.8 | 4.2 | 45.0 |
| " | " | P | " | 3.7 | 3.7 | 3.7 | 4.0 | 4.2 | 4.5 | 38.5 |
| " | " | Au | " | 4.5 | 4.5 | 4.6 | 4.8 | 5.0 | 5.2 | 45.0 |
| " | " | Ag | " | 6.3 | 5.4 | 5.5 | 5.7 | 5.9 | 6.3 | 48.0 |
| " | " | Ge | " | 4.4 | 4.4 | 4.5 | 4.6 | 4.7 | 5.0 | 43.1 |
| " | " | Sm | " | 3.5 | 3.7 | 3.8 | 3.9 | 4.2 | 4.5 | 44.0 |

TABLE 6(a)-continued

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | W (%) | Added elements | (%) | Water quenched condition after heated at 1,000° C. for one hour | | | | | | |
| " | " | Se | " | 4.4 | 4.5 | 4.5 | 5.0 | 5.3 | 5.5 | 46.0 |
| " | " | Ce | " | 3.5 | 3.5 | 3.6 | 3.8 | 3.9 | 4.3 | 42.5 |

TABLE 6(b)

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | W (%) | Added elements | (%) | Water quenched condition after heated at 1,000° C. for one hour | | | | | | |
| 96.5 | 1.0 | La | 2.6 | 4.0 | 4.0 | 4.0 | 4.3 | 4.5 | 5.0 | 45.9 |
| " | " | Bi | " | 4.1 | 4.1 | 4.3 | 4.5 | 4.8 | 5.2 | 45.5 |
| " | " | Pt | " | 4.5 | 4.5 | 4.5 | 4.6 | 4.7 | 5.1 | 50.1 |
| " | " | Pd | 4.6 | 4.6 | 4.6 | 4.7 | 4.8 | 5.5 | 46.6 | |
| " | " | Be | " | 3.9 | 3.9 | 3.9 | 4.0 | 4.4 | 5.0 | 53.4 |
| " | " | Mg | " | 5.5 | 5.8 | 6.0 | 6.4 | 7.0 | 7.3 | 44.2 |
| " | " | Re | " | 5.4 | 5.5 | 5.8 | 6.3 | 6.5 | 7.0 | 45.8 |
| " | " | Rh | " | 5.1 | 5.1 | 5.2 | 5.3 | 5.4 | 5.5 | 41.2 |
| " | " | Y | " | 4.8 | 4.8 | 4.9 | 5.1 | 5.5 | 5.7 | 43.0 |
| 98.5 | " | Pb | 0.5 | 4.3 | 4.3 | 4.4 | 4.5 | 5.0 | 6.2 | 43.5 |
| " | " | C | " | 3.8 | 3.8 | 3.9 | 3.9 | 4.0 | 4.2 | 45.1 |
| " | " | As | " | 3.1 | 3.3 | 3.5 | 3.7 | 3.9 | 4.0 | 46.0 |
| " | " | B | " | 3.2 | 3.2 | 3.4 | 3.6 | 3.9 | 4.2 | 58.0 |
| 98.8 | " | Eu | 0.2 | 4.5 | 4.5 | 4.5 | 4.6 | 4.8 | 5.0 | 51.0 |
| " | " | S | " | 4.1 | 4.1 | 4.1 | 4.3 | 4.4 | 4.5 | 46.0 |

TABLE 7(a)

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | Annealed condition by cooling at a rate of 100° C./hr after heated at 1,000° C. for one hour | | | | | | |
| 83.0 | 2.0 | Cr | 15.0 | 22.7 | 22.7 | 22.7 | 19.5 | 16.4 | 15.5 | 54.0 |
| 93.0 | " | Al | 5.0 | 12.6 | 12.6 | 12.6 | 12.5 | 12.6 | 12.6 | 41.0 |
| " | " | Ni | " | 6.1 | 6.1 | 6.1 | 6.0 | 6.0 | 6.4 | 51.5 |
| " | " | Mn | " | 6.0 | 6.0 | 6.0 | 6.1 | 6.2 | 6.7 | 44.2 |
| " | " | Sb | " | 5.7 | 5.7 | 5.7 | 5.6 | 5.5 | 5.0 | 42.2 |
| " | " | Nb | " | 7.1 | 7.2 | 7.2 | 7.2 | 7.5 | 7.8 | 50.5 |
| " | " | Ti | " | 8.4 | 8.4 | 8.4 | 8.5 | 8.6 | 9.0 | 50.2 |
| " | " | V | " | 8.8 | 8.8 | 8.8 | 9.1 | 9.6 | 9.8 | 51.1 |
| " | " | Ta | " | 7.7 | 7.7 | 7.7 | 7.9 | 8.0 | 8.3 | 52.3 |
| 95.5 | " | Sn | 2.5 | 8.4 | 8.4 | 8.4 | 8.4 | 8.5 | 9.0 | 51.5 |
| " | " | Zn | " | 7.7 | 7.7 | 7.7 | 7.8 | 7.9 | 8.0 | 42.4 |
| " | " | Zr | " | 6.5 | 6.5 | 6.5 | 6.6 | 6.9 | 7.3 | 40.9 |
| " | " | Cd | " | 5.4 | 5.4 | 5.4 | 5.6 | 5.8 | 6.2 | 40.1 |
| " | " | Gd | " | 6.3 | 6.3 | 6.3 | 6.4 | 6.5 | 7.0 | 39.8 |
| " | " | Ga | " | 6.5 | 6.5 | 6.5 | 6.7 | 6.8 | 7.3 | 40.0 |
| " | " | P | " | 6.6 | 6.6 | 6.7 | 6.8 | 7.0 | 7.2 | 39.5 |
| " | " | Au | " | 7.2 | 7.2 | 7.2 | 7.3 | 7.4 | 8.0 | 41.3 |
| " | " | Ag | " | 7.6 | 7.6 | 7.6 | 7.7 | 7.8 | 8.2 | 42.3 |
| " | " | Ge | " | 4.6 | 4.6 | 4.6 | 4.6 | 4.6 | 4.8 | 40.4 |
| " | " | Sm | " | 5.5 | 5.5 | 5.6 | 5.6 | 5.8 | 6.0 | 40.5 |
| " | " | Se | " | 6.8 | 6.8 | 6.8 | 7.0 | 7.3 | 7.5 | 41.2 |
| " | " | Ce | " | 5.4 | 5.4 | 5.5 | 5.7 | 5.9 | 7.0 | 40.9 |
| " | " | La | " | 6.5 | 6.5 | 6.6 | 6.7 | 6.6 | 6.5 | 41.3 |

TABLE 7(b)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | Annealed condition by cooling at a rate of 100° C./hr after heated at 1,000° C. for one hour | | | | | | |
| 95.5 | 2.0 | Bi | 2.5 | 5.7 | 5.7 | 5.7 | 5.8 | 5.9 | 6.2 | 42.3 |
| " | " | Pt | " | 6.6 | 6.6 | 6.7 | 6.8 | 7.0 | 7.4 | 45.5 |
| " | " | Pd | " | 8.2 | 8.2 | 8.3 | 8.4 | 8.5 | 8.4 | 44.2 |
| " | " | Be | " | 6.1 | 6.1 | 6.1 | 6.3 | 6.5 | 7.0 | 51.3 |
| " | " | Mg | " | 8.8 | 8.8 | 8.9 | 8.9 | 8.5 | 8.5 | 42.4 |
| " | " | Re | " | 7.9 | 7.9 | 8.1 | 8.3 | 8.5 | 9.0 | 40.8 |
| " | " | Rh | " | 6.8 | 6.8 | 6.9 | 7.2 | 7.5 | 8.0 | 40.5 |
| " | " | Y | " | 5.7 | 5.7 | 6.8 | 5.9 | 6.2 | 6.5 | 42.0 |
| 97.5 | " | Pb | 0.5 | 6.4 | 6.4 | 6.4 | 6.5 | 6.6 | 6.8 | 40.0 |
| " | " | C | " | 5.5 | 5.5 | 5.6 | 5.7 | 5.8 | 6.0 | 41.7 |
| " | " | As | " | 4.6 | 4.6 | 4.7 | 4.8 | 4.9 | 5.0 | 41.1 |
| " | " | B | " | 5.5 | 5.5 | 5.5 | 5.6 | 5.6 | 5.7 | 56.0 |
| 97.8 | " | Eu | 0.2 | 4.5 | 4.5 | 4.5 | 4.6 | 4.7 | 4.8 | 45.0 |
| " | " | S | " | 5.5 | 5.5 | 5.6 | 5.5 | 5.4 | 5.5 | 42.0 |

TABLE 8(a)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | 96% cold worked condition after annealed | | | | | | |
| 83.0 | 2.0 | Cr | 15.0 | 12.7 | 12.6 | 12.7 | 12.6 | 12.8 | 13.0 | 63.4 |
| 93.0 | " | Al | 5.0 | 6.3 | 6.5 | 6.7 | 6.6 | 6.4 | 6.0 | 51.2 |
| " | " | Ni | " | 5.0 | 5.0 | 5.0 | 5.8 | 5.9 | 6.0 | 58.5 |
| " | " | Mn | " | 5.4 | 5.4 | 5.5 | 5.6 | 5.7 | 5.9 | 49.7 |
| " | " | Sb | " | 5.0 | 5.0 | 5.1 | 5.1 | 5.2 | 5.0 | 50.2 |
| " | " | Nb | " | 6.1 | 6.1 | 6.2 | 6.3 | 6.4 | 6.5 | 58.8 |
| " | " | Ti | " | 5.5 | 5.4 | 5.3 | 5.2 | 5.1 | 5.0 | 59.4 |
| " | " | V | " | 6.3 | 6.3 | 6.3 | 6.3 | 6.4 | 6.5 | 57.1 |
| " | " | Ta | " | 4.4 | 4.5 | 4.6 | 4.8 | 5.0 | 5.2 | 59.9 |
| 95.5 | " | Sn | 2.5 | 6.3 | 6.3 | 6.4 | 6.6 | 7.0 | 7.3 | 59.5 |
| " | " | Zn | " | 5.4 | 5.4 | 5.5 | 5.6 | 5.8 | 6.0 | 50.4 |
| " | " | Zr | " | 4.3 | 4.3 | 4.5 | 4.8 | 4.8 | 4.5 | 49.9 |
| " | " | Cd | " | 4.3 | 4.3 | 4.2 | 4.1 | 4.0 | 4.3 | 48.6 |
| " | " | Gd | " | 5.4 | 5.4 | 5.5 | 5.7 | 5.9 | 6.2 | 47.3 |
| " | " | Ga | " | 4.3 | 4.3 | 4.5 | 4.7 | 4.9 | 5.0 | 48.8 |
| " | " | P | " | 5.6 | 5.6 | 5.6 | 5.7 | 5.8 | 5.6 | 47.5 |
| " | " | Au | " | 5.1 | 5.1 | 5.1 | 5.1 | 5.0 | 5.2 | 50.3 |
| " | " | Ag | " | 6.6 | 6.6 | 6.5 | 6.5 | 6.7 | 7.0 | 50.2 |
| " | " | Ge | " | 4.2 | 4.1 | 4.0 | 3.9 | 3.9 | 4.0 | 48.7 |
| " | " | Sm | " | 4.4 | 4.4 | 4.4 | 4.5 | 4.6 | 4.6 | 49.9 |
| " | " | Se | " | 4.8 | 4.8 | 4.9 | 5.0 | 5.0 | 4.9 | 50.2 |
| " | " | Ce | " | 4.2 | 4.2 | 4.2 | 4.0 | 3.8 | 3.9 | 46.9 |
| " | " | La | " | 4.5 | 4.5 | 4.5 | 4.6 | 4.8 | 5.0 | 48.0 |

TABLE 8(b)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | 96% cold worked condition after annealed | | | | | | |
| 95.5 | 2.0 | Bi | 2.6 | 5.0 | 5.0 | 5.0 | 4.9 | 4.9 | 5.0 | 50.3 |
| " | " | Pt | " | 4.6 | 4.6 | 4.6 | 4.7 | 4.9 | 5.1 | 53.5 |
| " | " | Pd | " | 6.2 | 6.2 | 6.3 | 6.4 | 6.5 | 7.0 | 51.2 |
| " | " | Be | " | 5.1 | 5.1 | 5.2 | 5.3 | 5.4 | 5.7 | 59.4 |
| " | " | mg | " | 6.8 | 6.8 | 6.7 | 6.6 | 6.5 | 6.5 | 50.2 |
| " | " | Re | " | 5.9 | 5.9 | 5.9 | 6.0 | 6.1 | 6.3 | 46.8 |
| " | " | Rh | " | 5.7 | 5.7 | 5.7 | 5.5 | 5.4 | 5.4 | 45.8 |
| 97.5 | " | Pb | 0.5 | 4.4 | 4.4 | 4.4 | 4.5 | 4.6 | 4.8 | 48.0 |
| " | " | C | " | 3.9 | 3.9 | 3.9. 3.8 | 3.8 | 4.0 | 50.7 | |
| " | " | As | " | 3.5 | 3.5 | 3.6 | 3.7 | 3.6 | 3.6 | 47.7 |
| " | " | B | " | 3.7 | 3.7 | 3.7 | 3.7 | 3.8 | 4.0 | 60.3 |
| 97.8 | " | Eu | 0.2 | 4.1 | 4.1 | 4.1 | 4.2 | 4.3 | 4.3 | 53.2 |

TABLE 8(b)-continued

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | 96% cold worked condition after annealed | | | | | | |
| " | " | S | " | 3.3 | 3.3 | 3.3 | 3.4 | 3.5 | 3.7 | 50.0 |

TABLE 9(a)

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | Water quenched condition after heated at 1,000° C. for one hour | | | | | | |
| 83.0 | 2.0 | Cr | 15.0 | 13.2 | 13.2 | 13.5 | 13.6 | 14.0 | 14.0 | 60.4 |
| 93.0 | " | Al | 5.0 | 6.5 | 6.5 | 6.8 | 6.9 | 7.0 | 7.2 | 48.0 |
| " | " | Ni | " | 5.4 | 5.4 | 5.4 | 5.6 | 5.8 | 6.1 | 55.5 |
| " | " | Mn | " | 5.9 | 5.9 | 5.9 | 5.9 | 6.0 | 6.3 | 44.7 |
| " | " | Sb | " | 5.3 | 5.3 | 5.3 | 5.3 | 5.4 | 5.5 | 46.2 |
| " | " | Nb | " | 6.4 | 6.4 | 6.5 | 6.5 | 6.6 | 6.7 | 53.6 |
| " | " | Ti | " | 5.7 | 5.7 | 5.8 | 5.8 | 5.9 | 5.9 | 55.4 |
| " | " | V | " | 6.5 | 6.5 | 6.5 | 6.3 | 6.2 | 6.1 | 34.1 |
| " | " | Ta | " | 4.7 | 4.8 | 4.9 | 4.9 | 5.0 | 5.3 | 55.6 |
| 95.5 | " | Sn | 2.5 | 6.5 | 6.5 | 6.5 | 6.7 | 6.7 | 6.9 | 53.5 |
| " | " | Zn | " | 5.7 | 5.7 | 5.7 | 5.8 | 6.0 | 6.4 | 45.4 |
| " | " | Zr | " | 4.6 | 4.6 | 4.7 | 4.7 | 4.8 | 4.9 | 46.0 |
| " | " | Cd | " | 4.5 | 4.5 | 4.5 | 4.6 | 4.7 | 4.8 | 43.6 |
| " | " | Gd | " | 4.7 | 4.7 | 4.7 | 4.8 | 4.8 | 4.9 | 43.3 |
| " | " | Ga | " | 5.7 | 5.7 | 5.7 | 5.8 | 5.9 | 6.0 | 41.2 |
| " | " | P | " | 5.7 | 5.8 | 5.9 | 6.0 | 6.2 | 6.5 | 42.5 |
| " | " | Au | " | 5.4 | 5.4 | 5.4 | 5.5 | 5.6 | 5.7 | 45.2 |
| " | " | Ag | " | 6.7 | 6.7 | 6.8 | 6.8 | 6.9 | 7.0 | 44.1 |
| " | " | Ge | " | 4.5 | 4.5 | 4.5 | 4.6 | 4.7 | 5.0 | 41.7 |
| " | " | Sm | " | 4.6 | 4.6 | 4.6 | 4.7 | 4.8 | 4.9 | 42.2 |
| " | " | Se | " | 5.0 | 5.0 | 5.0 | 5.0 | 5.3 | 5.1 | 46.3 |
| " | " | Ce | " | 4.5 | 4.6 | 4.8 | 4.7 | 4.6 | 4.5 | 42.3 |
| " | " | La | " | 4.7 | 4.5 | 4.6 | 4.6 | 4.5 | 4.4 | 41.0 |

TABLE 9(b)

| Composition | | | | Damping capacity $Q^{-1}$ ($\times 10^{-3}$) | | | | | | Tensile strength (Kg/mm², 20° C.) |
|---|---|---|---|---|---|---|---|---|---|---|
| | | | | 0° C. | 50° C. | 100° C. | 200° C. | 300° C. | 400° C. | |
| Fe (%) | Si (%) | Added elements | (%) | Water quenched condition after heated at 1,000° C. for one hour | | | | | | |
| 95.5 | 2.0 | Bi | 2.6 | 5.1 | 5.1 | 5.1 | 5.2 | 5.3 | 5.5 | 46.6 |
| " | " | Pt | " | 4.9 | 4.9 | 4.9 | 5.0 | 5.0 | 5.2 | 50.5 |
| " | " | Pd | " | 6.3 | 6.3 | 6.4 | 6.5 | 7.0 | 7.1 | 46.0 |
| " | " | Be | " | 5.7 | 5.7 | 5.7 | 5.8 | 6.4 | 6.7 | 54.4 |
| " | " | Mg | " | 7.2 | 7.2 | 7.2 | 7.4 | 7.6 | 7.7 | 44.6 |
| " | " | Re | " | 6.0 | 6.0 | 6.0 | 6.1 | 6.1 | 5.9 | 42.7 |
| " | " | Rh | " | 6.1 | 6.1 | 6.1 | 6.2 | 6.2 | 6.1 | 41.8 |
| " | " | Y | " | 4.9 | 4.9 | 4.9 | 4.9 | 5.0 | 5.2 | 43.0 |
| 97.5 | " | Pb | 0.5 | 4.5 | 4.5 | 4.6 | 4.6 | 4.7 | 4.8 | 42.0 |
| " | " | C | " | 4.1 | 4.2 | 4.3 | 4.3 | 4.4 | 4.4 | 46.8 |
| " | " | As | " | 3.8 | 3.9 | 3.9 | 3.9 | 3.8 | 3.7 | 44.7 |
| " | " | B | " | 4.0 | 4.0 | 4.1 | 4.1 | 4.0 | 3.9 | 55.4 |
| 97.8 | " | Eu | 0.2 | 4.5 | 4.5 | 4.5 | 4.6 | 4.6 | 4.7 | 50.2 |
| " | " | S | " | 3.5 | 3.5 | 3.5 | 3.6 | 3.7 | 3.8 | 46.0 |

TABLE 10(a)

| Composition | | | | Damping capacity $Q^{-1}$ ($\times 10^{-3}$) | | | | | | Tensile strength (kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements | (%) | Annealed condition by cooling at a rate of 100° C./hr after heated at 1,000° C. for one hour | | | | | | |
| 84.0 | 1.0 | Cr | 15.0 | 27.0 | 27.0 | 27.0 | 27.0 | 27.5 | 29.0 | 56.0 |
| 94.0 | " | Al | 5.0 | 13.5 | 13.5 | 13.5 | 13.7 | 14.4 | 16.0 | 42.0 |
| | — | Ni | " | 7.3 | 7.3 | 7.3 | 7.2 | 7.0 | 7.1 | 55.0 |
| | " | Mn | " | 8.2 | 8.2 | 8.2 | 8.1 | 8.0 | 6.8 | 45.0 |
| | " | sb | " | 6.7 | 6.7 | 6.7 | 6.6 | 6.5 | 6.0 | 43.2 |
| | " | Nb | " | 5.7 | 5.7 | 5.7 | 5.7 | 5.9 | 6.0 | 56.0 |
| | " | V | " | 7.4 | 7.4 | 7.6 | 7.6 | 7.9 | 8.3 | 58.0 |
| | " | Ta | " | 6.3 | 6.3 | 6.3 | 6.5 | 6.6 | 7.0 | 61.4 |
| 96.5 | " | Sn | 2.5 | 6.6 | 6.6 | 6.7 | 6.9 | 7.4 | 7.7 | 51.5 |
| | " | Zn | " | 6.2 | 6.2 | 6.2 | 6.3 | 6.5 | 7.1 | 50.4 |
| | " | Zr | " | 4.4 | 4.4 | 4.5 | 4.7 | 4.6 | 5.2 | 49.3 |
| | " | Cd | " | 5.2 | 5.2 | 5.4 | 5.5 | 5.7 | 6.0 | 48.0 |
| | " | Gd | " | 4.1 | 4.1 | 4.2 | 4.5 | 5.0 | 6.0 | 49.9 |
| | " | Ga | " | 5.4 | 5.4 | 5.4 | 5.5 | 5.6 | 5.8 | 49.0 |
| | " | P | " | 4.6 | 4.6 | 4.7 | 4.8 | 4.0 | 5.2 | 40.3 |
| | " | Au | " | 4.4 | 4.4 | 4.4 | 4.4 | 4.5 | 4.8 | 49.4 |
| | " | Ag | " | 5.3 | 5.3 | 5.3 | 5.4 | 5.4 | 5.7 | 51.0 |
| | " | Ge | " | 4.4 | 4.8 | 4.8 | 4.8 | 5.0 | 5.6 | 48.7 |
| | " | Sm | " | 3.8 | 3.8 | 3.8 | 3.8 | 3.9 | 4.3 | 50.2 |
| | " | Se | " | 4.5 | 4.5 | 4.5 | 4.5 | 4.7 | 6.0 | 51.3 |
| | " | Ce | " | 3.9 | 3.9 | 3.9 | 3.9 | 4.0 | 4.3 | 48.5 |
| | " | La | " | 4.6 | 4.6 | 4.6 | 4.7 | 4.8 | 5.0 | 50.0 |
| | " | Bi | " | 4.5 | 4.6 | 4.8 | 4.8 | 4.7 | 5.0 | 49.5 |

TABLE 10(b)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements | (%) | Annealed condition by cooling at a rate of 100° C./hr after heated at 1,000° C. for one hour | | | | | | |
| 96.5 | 1.0 | Pt | 2.5 | 4.3 | 4.3 | 4.3 | 4.5 | 4.7 | 5.0 | 44.0 |
| " | " | Pd | " | 4.6 | 4.6 | 4.6 | 4.7 | 4.8 | 5.3 | 53.0 |
| " | " | Be | " | 5.2 | 5.2 | 5.2 | 5.3 | 5.4 | 5.7 | 55.5 |
| " | " | Mg | " | 4.9 | 4.9 | 4.9 | 4.9 | 5.0 | 5.5 | 50.2 |
| " | " | Re | " | 6.2 | 6.2 | 6.4 | 6.5 | 7.2 | 7.7 | 53.0 |
| " | " | Rh | " | 6.7 | 6.7 | 6.7 | 6.7 | 6.8 | 7.0 | 49.6 |
| " | " | Y | " | 5.4 | 5.4 | 5.4 | 5.5 | 5.7 | 6.2 | 50.1 |
| 98.5 | " | Pb | 0.5 | 4.3 | 4.3 | 4.4 | 4.5 | 4.7 | 5.1 | 50.0 |
| " | " | C | " | 5.0 | 5.0 | 5.0 | 5.1 | 5.5 | 5.8 | 51.3 |
| " | " | As | " | 3.5 | 3.5 | 3.5 | 3.5 | 3.7 | 4.0 | 51.0 |
| " | " | B | " | 4.0 | 4.0 | 4.0 | 4.0 | 4.4 | 4.6 | 57.0 |
| 98.8 | " | Eu | 0.2 | 4.3 | 4.3 | 4.4 | 4.5 | 4.7 | 5.0 | 55.0 |
| " | " | S | " | 3.6 | 3.6 | 3.6 | 3.7 | 3.9 | 4.1 | 53.0 |

TABLE 11(a)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements | (%) | 96% cold worked condition after annealed | | | | | | |
| 84.0 | 1.0 | Cr | 15.0 | 11.5 | 11.5 | 11.6 | 11.8 | 12.4 | 13.0 | 65.3 |
| 94.0 | " | Al | 5.0 | 6.5 | 6.5 | 6.5 | 6.6 | 7.0 | 7.5 | 53.3 |
| " | " | Ni | " | 5.4 | 5.4 | 5.4 | 5.6 | 5.6 | 5.7 | 64.5 |
| " | " | Mn | " | 4.6 | 4.6 | 4.6 | 4.6 | 4.7 | 4.9 | 56.4 |
| " | " | Sb | " | 3.9 | 3.9 | 3.9 | 3.9 | 4.0 | 4.3 | 52.1 |
| " | " | Nb | " | 4.8 | 4.8 | 4.8 | 4.8 | 4.8 | 5.0 | 61.0 |
| " | " | V | " | 5.2 | 5.2 | 5.2 | 5.2 | 5.4 | 5.7 | 64.4 |
| " | " | Ta | " | 5.2 | 5.2 | 5.2 | 5.2 | 5.4 | 5.8 | 60.3 |
| 96.5 | " | Sn | 2.5 | 4.6 | 4.6 | 4.6 | 4.6 | 4.8 | 5.0 | 59.0 |
| " | " | Zn | " | 4.2 | 4.2 | 4.2 | 4.3 | 4.4 | 4.7 | 58.8 |
| " | " | Zr | " | 2.8 | 2.8 | 2.8 | 2.8 | 3.0 | 3.9 | 57.7 |
| " | " | Cd | " | 4.7 | 4.7 | 4.7 | 4.7 | 4.8 | 5.0 | 56.6 |
| " | " | Gd | " | 3.8 | 3.8 | 3.8 | 3.8 | 3.9 | 4.4 | 58.7 |
| " | " | Ga | " | 4.4 | 4.4 | 4.4 | 4.5 | 4.7 | 5.0 | 57.6 |

TABLE 11(a)-continued

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements (%) | | 96% cold worked condition after annealed | | | | | | |
| " | " | P | " | 3.9 | 3.9 | 3.9 | 3.9 | 4.0 | 4.3 | 49.9 |
| " | " | Au | " | 3.7 | 3.7 | 3.7 | 3.7 | 3.9 | 4.0 | 56.0 |
| " | " | Ag | " | 3.6 | 3.6 | 3.6 | 3.6 | 3.6 | 3.8 | 57.0 |
| " | " | Ge | " | 3.5 | 3.5 | 3.5 | 3.5 | 3.6 | 3.7 | 58.9 |
| " | " | Sm | " | 3.4 | 3.4 | 3.4 | 3.4 | 3.7 | 3.9 | 59.9 |
| " | " | Se | " | 3.7 | 3.7 | 3.7 | 3.7 | 3.9 | 4.2 | 60.2 |
| " | " | Ce | " | 3.3 | 3.3 | 3.3 | 3.3 | 3.2 | 3.1 | 57.6 |
| " | " | La | " | 3.6 | 3.6 | 3.6 | 3.6 | 3.7 | 3.9 | 59.0 |
| " | " | Bi | " | 4.0 | 4.0 | 4.0 | 4.0 | 4.1 | 4.4 | 59.5 |

TABLE 11(b)

| Composition | | | | Damping capacity $Q^{-1}$ ($\times 10^{-3}$) | | | | | | Tensile strength (Kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements (%) | | 96% cold worked condition after annealed | | | | | | |
| 96.5 | 1.0 | Pt | 2.6 | 3.3 | 3.3 | 3.3 | 3.3 | 3,3 | 3.4 | 59.9 |
| " | " | Pd | " | 3.2 | 3.2 | 3.2 | 3.2 | 3.3 | 3.5 | 60.1 |
| " | " | Be | " | 4.0 | 4.0 | 4.0 | 4.0 | 4.1 | 4.3 | 64.3 |
| " | " | Mg | " | 3.8 | 3.8 | 3.8 | 3.8 | 3.8 | 3.9 | 60.3 |
| " | " | Re | " | 4.1 | 4.1 | 4.1 | 4.2 | 4.3 | 4.4 | 61.4 |
| " | " | Rh | " | 4.5 | 4.5 | 4.5 | 4.5 | 4.6 | 4.7 | 59.5 |
| " | " | Y | " | 4.4 | 4.4 | 4.4 | 4.4 | 4.5 | 4.8 | 59.6 |
| 98.5 | " | Pb | 0.5 | 3.5 | 3.5 | 3.5 | 3.5 | 3.7 | 3.9 | 58.4 |
| " | " | C | " | 4.0 | 4.0 | 4.0 | 4.0 | 4.2 | 4.3 | 59.6 |
| " | " | As | " | 3.0 | 3.0 | 3.0 | 3.2 | 3.5 | 3.8 | 57.5 |
| " | " | B | " | 3.5 | 3.5 | 3.5 | 3.6 | 3.7 | 3.9 | 65.4 |
| 98.9 | " | Eu | 0.2 | 3.3 | 3.3 | 3.3 | 3.3 | 3.5 | 3.8 | 63.6 |
| " | " | S | " | 3.2 | 3.2 | 3.2 | 3.2 | 3.2 | 3.6 | 60.8 |

TABLE 12(a)

| Composition | | | | Damping capacity $Q^{-1}$ ($\times 10^{-3}$) | | | | | | Tensile strength (Kg/mm$^2$, 20° C. |
|---|---|---|---|---|---|---|---|---|---|---|
| | | | | 0° C. | 50° C. | 100° C. | 200° C. | 300° C. | 400° C. | |
| Fe (%) | Ti (%) | Added elements (%) | | Water quenched condition after heated at 1,000° C. for one hour | | | | | | |
| 84.0 | 1.0 | Cr | 15.0 | 12.3 | 12.3 | 12.4 | 12.5 | 12.6 | 13.0 | 61.4 |
| 94.0 | " | Al | 5.0 | 7.2 | 7.2 | 7.2 | 7.2 | 7.3 | 7.6 | 49.3 |
| " | " | Ni | " | 6.4 | 6.4 | 6.4 | 6.4 | 6.4 | 6.6 | 59.5 |
| " | " | Mn | " | 5.1 | 5.1 | 5.1 | 5.1 | 5.2 | 5.3 | 51.6 |
| " | " | Sb | " | 4.3 | 4.3 | 4.3 | 4.3 | 4.3 | 4.4 | 48.1 |
| " | " | Nb | " | 5.3 | 5.3 | 5.3 | 5.4 | 5.5 | 5.7 | 57.0 |
| " | " | V | " | 5.5 | 5.5 | 5.5 | 5.5 | 5.6 | 5.8 | 59.3 |
| " | 4· | Ta | " | 5.6 | 5.6 | 5.6 | 5.6 | 5.7 | 6.0 | 55.0 |
| 96.5 | " | Sn | 2.6 | 5.0 | 5.0 | 5.0 | 5.0 | 5.0 | 5.6 | 54.0 |
| " | " | Zn | " | 4.6 | 4.6 | 4.6 | 4.6 | 4.7 | 4.9 | 53.8 |
| " | " | Zr | " | 3.3 | 3.3 | 3.3 | 3.3 | 3.4 | 3.6 | 52.6 |
| " | \| | Cd | " | 5.1 | 5.1 | 5.1 | 5.2 | 5.5 | 6.0 | 51.5 |
| " | " | Gd | " | 4.3 | 4.3 | 4.4 | 4.5 | 4.7 | 5.0 | 53.7 |
| " | 41 | Ga | " | 4.9 | 4.9 | 4.9 | 4.9 | 5.0 | 5.3 | 52.4 |
| " | " | P | " | 4.4 | 4.4 | 4.4 | 4.5 | 4.6 | 4.7 | 45.8 |
| " | " | Au | " | 4.2 | 4.2 | 4.2 | 4.2 | 4.2 | 4.5 | 51.0 |
| " | " | Ag | " | 4.0 | 4.0 | 4.0 | 4.0 | 4.1 | 4.4 | 52.3 |
| " | " | Ge | " | 3.9 | 3.9 | 3.9 | 3.9 | 3.9 | 4.2 | 53.8 |
| " | " | Sm | " | 4.0 | 4.0 | 4.0 | 4.1 | 4.2 | 4.4 | 55.0 |
| " | " | Se | " | 4.2 | 4.2 | 4.2 | 4.2 | 4.3 | 4.6 | 55.2 |
| " | ∝ | Ce | " | 3.6 | 3.6 | 3.6 | 3.7 | 4.0 | 4.5 | 52.6 |
| " | " | La | " | 4.0 | 4.0 | 4.0 | 4.0 | 4.1 | 4.3 | 55.0 |
| " | " | Bi | " | 4.3 | 4.3 | 4.3 | 4.3 | 4.4 | 4.7 | 55.5 |

TABLE 12(b)

| Composition | | | | Damping capacity $Q^{-1}$ ($\times 10^{-3}$) | | | | | | Tensile strength (kg/mm$^2$, 20° C.) |
|---|---|---|---|---|---|---|---|---|---|---|
| | | | | 0° C. | 50° C. | 100° C. | 200° C. | 300° C. | 400° C. | |
| Fe (%) | Ti (%) | Added elements (%) | | Water quenched condition after heated at 1,000° C. for one hour | | | | | | |
| 96.5 | 1.0 | Pt | 2.5 | 3.8 | 3.8 | 3.8 | 3.8 | 3.8 | 3.9 | 55.7 |
| " | " | Pd | " | 3.6 | 3.6 | 3.6 | 3.6 | 3.6 | 3.7 | 55.4 |
| " | " | Be | " | 4.4 | 4.4 | 4.4 | 4.4 | 4.5 | 4.7 | 59.1 |
| " | " | Mg | " | 4.2 | 4.2 | 4.2 | 4.3 | 4.6 | 4.9 | 55.2 |
| " | " | Re | " | 4.5 | 4.5 | 4.5 | 4.5 | 4.6 | 4.7 | 55.3 |
| " | " | Rh | " | 4.8 | 4.8 | 4.8 | 4.9 | 5.1 | 5.3 | 55.4 |
| " | " | Y | " | 4.8 | 4.8 | 4.8 | 5.1 | 5.3 | 5.8 | 55.6 |
| 98.5 | " | Pb | 0.5 | 3.9 | 3.9 | 3.9 | 4.0 | 4.4 | 5.0 | 52.4 |
| " | " | C | " | 4.2 | 4.2 | 4.2 | 4.2 | 4.2 | 4.4 | 55.9 |
| " | " | As | " | 3.4 | 3.4 | 3.4 | 3.4 | 3.5 | 4.0 | 52.5 |
| " | " | B | " | 3.9 | 3.9 | 3.9 | 3.9 | 4.0 | 4.1 | 60.3 |
| 98.8 | " | Eu | 0.2 | 3.5 | 3.5 | 3.5 | 3.5 | 3.5 | 3.7 | 58.0 |
| " | " | S | " | 3.5 | 3.5 | 3.7 | 4.0 | 4.4 | 5.0 | 55.1 |

TABLE 13(a)

| Composition | | | | | | Damping capacity $Q^{-1}$ ($\times 10^{-3}$) | | | | | | Tensile strength (kg/mm$^2$,) |
|---|---|---|---|---|---|---|---|---|---|---|---|---|
| | | | | | | 0° C. | 50° C. | 100° C. | 200° C. | 300° C. | 400° C. | 20° C.) |
| Fe (%) | W (%) | Si (%) | Ti (%) | Added elements (%) | | Annealed condition by cooling at a rate of 100° C./hr after heated at 1,000° C. for one hour | | | | | | |
| 81.0 | 3.0 | 1.0 | — | Cr | 15.0 | 28.0 | 28.5 | 29.0 | 27.9 | 26.0 | 24.0 | 56.0 |
| 93.0 | " | " | — | Al | 3.0 | 24.0 | 24.5 | 25.0 | 24.2 | 23.0 | 20.1 | 51.1 |
| " | " | " | — | Ni | " | 18.3 | 18.4 | 19.5 | 19.0 | 18.6 | 15.7 | 53.3 |
| " | " | " | — | Mn | " | 19.6 | 19.8 | 20.0 | 18.7 | 10.0 | 14.2 | 52.2 |
| " | " | " | — | Sb | " | 22.0 | 22.4 | 23.0 | 21.0 | 19.6 | 16.0 | 50.1 |
| " | " | " | — | Nb | " | 21.0 | 21.3 | 22.2 | 21.5 | 20.3 | 19.1 | 57.0 |
| " | " | " | — | V | " | 25.0 | 25.3 | 25.6 | 25.0 | 23.1 | 21.2 | 53.0 |
| " | " | " | — | Ta | " | 20.6 | 20.6 | 25.8 | 25.0 | 24.1 | 23.9 | 50.6 |
| 95.0 | " | " | — | Be | 1.0 | 26.0 | 126.5 | 26.7 | 26.4 | 25.7 | 24.0 | 51.0 |
| 95.5 | " | " | — | Pb | 0.5 | 24.6 | 25.0 | 25.8 | 25.0 | 24.3 | 23.0 | 50.3 |
| 95.8 | " | " | — | C | 0.2 | 17.6 | 17.8 | 17.0 | 16.7 | 16.0 | 13.0 | 54.5 |
| 80.0 | " | — | 2.0 | Cr | 15.0 | 35.0 | 35.0 | 36.1 | 35.8 | 34.0 | 32.0 | 53.0 |
| 92.0 | " | — | " | Al | 3.0 | 27.0 | 27.0 | 27.5 | 27.1 | 26.6 | 24.3 | 50.5 |
| " | " | — | " | Ni | " | 24.0 | 24.7 | 25.0 | 24.8 | 24.0 | 21.0 | 52.2 |
| " | " | — | " | Mn | " | 20.3 | 21.0 | 21.6 | 21.0 | 20.0 | 18.3 | 51.3 |
| " | " | — | " | Sb | " | 24.0 | 25.0 | 25.8 | 25.1 | 24.0 | 21.9 | 49.9 |
| " | " | — | " | Nb | " | 23.0 | 23.6 | 23.6 | 23.0 | 21.2 | 20.4 | 55.7 |
| " | " | — | " | V | " | 26.0 | 26.5 | 27.0 | 26.3 | 25.0 | 21.1 | 52.0 |
| " | " | — | " | Ta | " | 23.4 | 24.0 | 24.0 | 23.6 | 21.8 | 20.2 | 49.9 |
| 94.0 | " | — | " | Be | 1.0 | 25.3 | 25.4 | 25.4 | 24.6 | 23.0 | 21.6 | 50.0 |
| 94.5 | " | — | " | Pb | 0.5 | 25.4 | 25.5 | 25.8 | 24.7 | 23.3 | 22.0 | 49.8 |
| 94.8 | " | — | " | C | 0.2 | 19.6 | 19.8 | 20.0 | 19.3 | 18.7 | 17.6 | 52.2 |

TABLE 13(b)

| Composition | | | | | | Damping capacity $Q^{-1}$ ($\times 10^{-3}$) | | | | | | Tensile strength (kg/mm$^2$, 20° C.) |
|---|---|---|---|---|---|---|---|---|---|---|---|---|
| | | | | | | 0°C. | 50° C. | 100° C. | 200° C. | 300° C. | 400° C. | |
| Fe (%) | W (%) | Si (%) | Ti (%) | Added elements (%) | | Annealed condition by cooling at a rate of 100° C./hr after heated at 1,000° C. for one hour | | | | | | |
| 82.0 | — | 1.0 | 2.0 | Cr | 15.0 | 33.3 | 34.1 | 34.2 | 33.0 | 32.2 | 30.8 | 54.4 |
| 94.0 | — | " | " | Al | 3.0 | 27.8 | 28.0 | 28.6 | 28.2 | 27.0 | 25.4 | 49.9 |
| " | — | " | " | Ni | " | 26.6 | 26.8 | 27.0 | 26.7 | 25.0 | 23.1 | 50.3 |
| " | — | " | " | Mn | " | 25.3 | 25.6 | 25.9 | 25.0 | 24.0 | 21.3 | 49.7 |
| " | — | " | " | Sb | " | 23.0 | 23.3 | 23.5 | 23.0 | 21.6 | 20.4 | 51.0 |
| " | — | " | " | Nb | " | 24.0 | 24.0 | 24.5 | 24.3 | 23.3 | 21.1 | 54.7 |
| " | — | " | " | V | " | 28.0 | 28.1 | 28.0 | 27.7 | 26.0 | 124.6 | 53.0 |
| " | — | " | " | Ta | " | 25.5 | 25.7 | 26.0 | 25.7 | 24.0 | 22.0 | 49.8 |
| 96.0 | — | " | " | Be | 1.0 | 28.0 | 28.4 | 29.0 | 28.5 | 27.0 | 25.4 | 50.2 |
| 96.6 | — | " | " | Pb | 0.5 | 24.0 | 24.0 | 24.0 | 23.7 | 22.5 | 21.0 | 48.0 |
| 96.8 | — | " | " | C | 0.2 | 17.0 | 17.1 | 17.6 | 17.2 | 16.7 | 15.0 | 51.1 |
| 79.0 | 3.0 | " | " | Cr | 15.0 | 36.0 | 36.5 | 36.6 | 35.9 | 34.0 | 32.0 | 57.7 |

TABLE 13(b)-continued

| Composition | | | | | | Damping capacity $Q^{-1}$ ($\times 10^{-3}$) | | | | | | Tensile strength (kg/mm², 20° C.) |
|---|---|---|---|---|---|---|---|---|---|---|---|---|
| | | | | | | 0°C. | 50° C. | 100° C. | 200° C. | 300° C. | 400° C. | |
| Fe (%) | W (%) | Si (%) | Ti (%) | Added elements (%) | | Annealed condition by cooling at a rate of 100° C./hr after heated at 1,000° C. for one hour | | | | | | |
| 91.0 | " | " | " | Al | 3.0 | 33.2 | 33.5 | 33.5 | 32.0 | 31.0 | 30.0 | 54.6 |
| " | " | " | " | Be | 1.0 | 31.0 | 31.4 | 31.3 | 30.3 | 29.5 | 28.0 | 54.4 |
| " | " | " | " | Pb | 0.5 | 27.2 | 27.8 | 29.0 | 28.0 | 27.0 | 25.0 | 51.1 |
| " | " | " | " | C | 0.2 | 23.3 | 23.4 | 23.5 | 23.0 | 22.0 | 20.0 | 54.0 |

As can be seen from Tables 1–13, the damping capacity of the alloy according to the invention is very high, i.e. more than about $2\times10^{-3}$, irrespective of binary, ternary or multi-component alloy and the treatments. The damping capacity of the alloys is highest, i.e. about $36.0\times10^{-3}$, under the annealed condition, and decreases in the order of the water quenched and cold worked conditions. The values of the damping capacity are much higher by the factor of several tens than those of the normal metals.

Figure 1B:
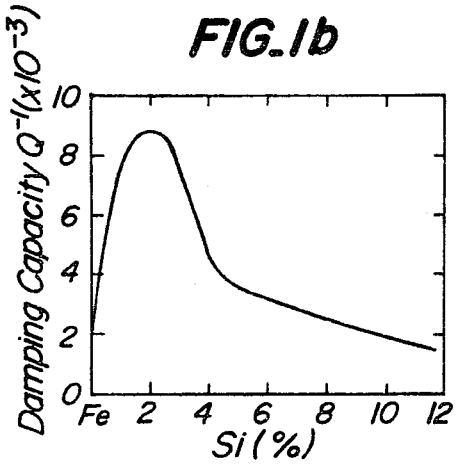
Figure 1C:
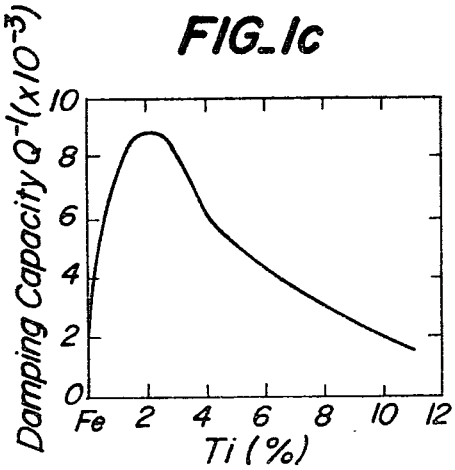

FIG. 1*a* shows the relationship between the damping capacity and the amount of tungsten of the Fe-W alloy according to the invention under annealed condition, FIG. 1*b* shows the relationship between the damping capacity and the amount of silicon of the Fe-Si alloy according to the invention under annealed condition, and FIG. 1*c* shows the relationship between the damping capacity and the amount of titanium of the Fe-Ti alloy according to the invention under annealed condition.

Figure 2A:
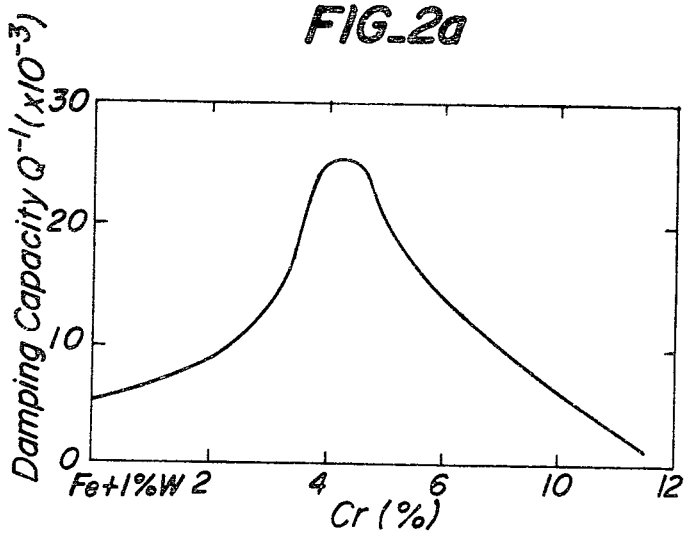
FIGS. 2*a*, 2*b* and 2*c* are graphical representations of a relationship between the composition and damping capacity of the alloys of Fe-1%W-Cr, Fe-1%Si-Cr and Fe-1%Ti-Cr according to the invention under annealed condition, respectively.
Figure 2B:
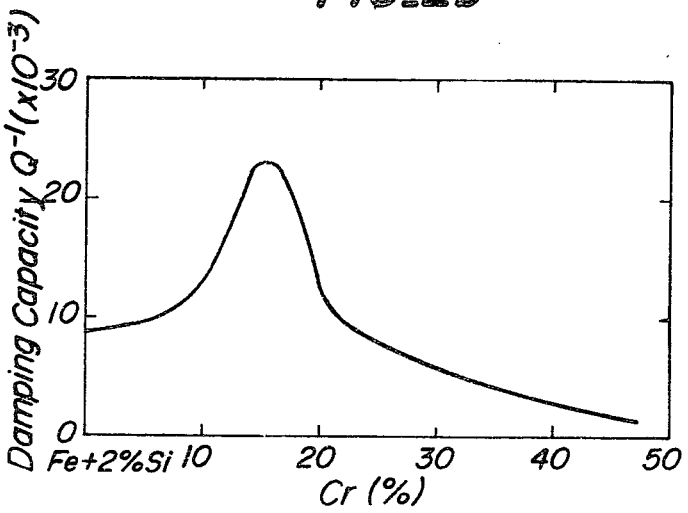
Figure 2C:
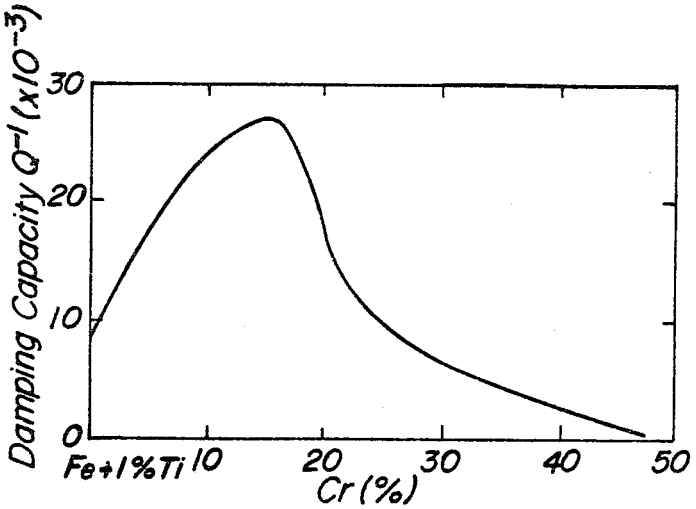

FIG. 2*a* illustrates the relationship between the damping capacity and the amount of chromium of the Fe-1%W-Cr alloy according to the invention under annealed condition, and FIG. 2*b* illustrates the relationship between the damping capacity and the amount of chromium of the Fe-1%Si-Cr alloy according to the invention under annealed condition, and FIG. 2*c* illustrates the relationship between the damping capacity and the amount of chromium of the Fe-1%Ti-Cr alloy according to the invention under annealed condition.

Figure 3A:
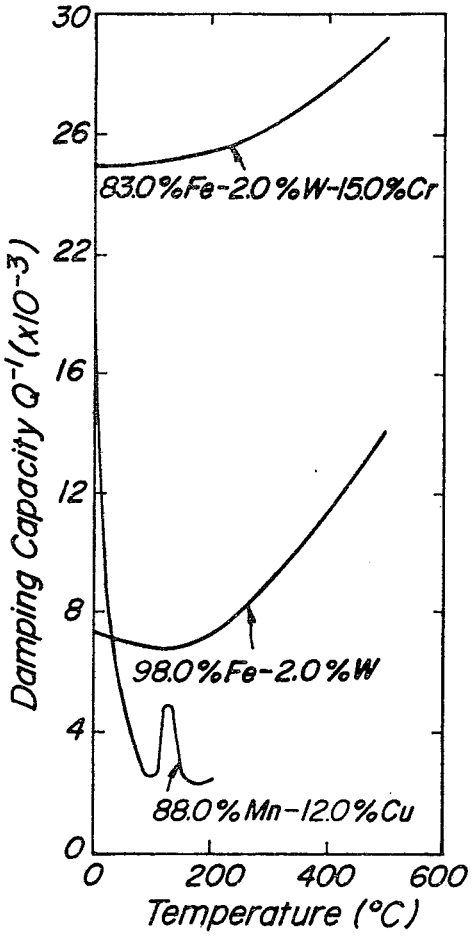
FIGS. 3*a*, 3*b* and 3*c* are graphical representations showing a difference between the damping capacity characteristics of the alloys of Fe-W, Fe-W-Cr, Fe-Si, Fe-Si-Cr, Fe-Ti and Fe-Ti-Cr according to the invention and Mn-Cu in the prior art at various temperatures, respectively.
Figure 3B:
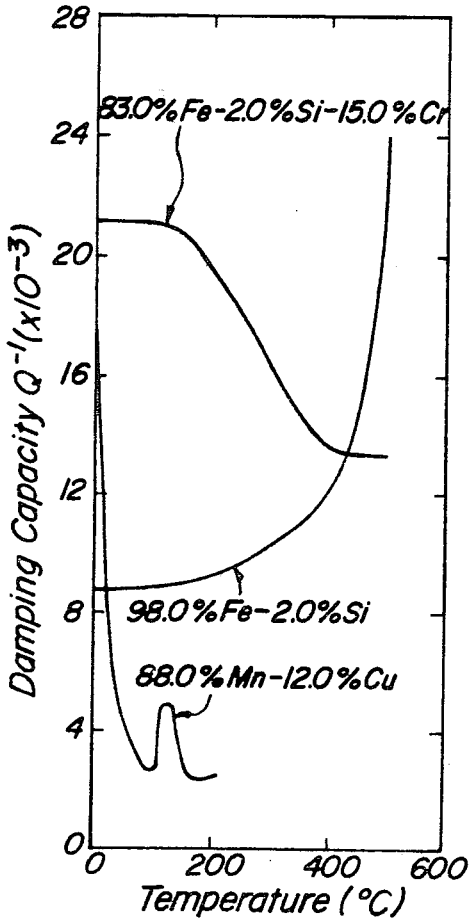
Figure 3C:
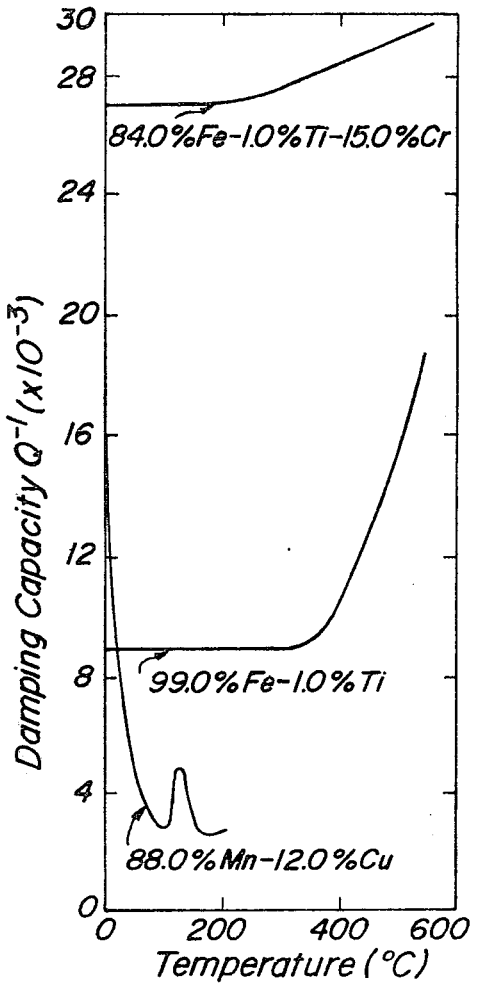

FIG. 3*a* shows the relationship between the heating temperature and the damping capacity in the 98%Fe-2%W alloy and the 83%Fe-2%W-15%Cr alloy according to the invention and the 88%Mn-12%Cu alloy of the prior art under annealed condition, and FIG. 3*b* shows the relationship between the heating temperature and the damping capacity in the 98%Fe-2%Si alloy and the 83%Fe-2%Si-15%Cr alloy according to the invention and the 88%Mn-12%Cu alloy of the prior art under annealed condition, and FIG. 3*c* shows the relationship between the heating temperature and the damping capacity in the 99%Fe-1%Ti alloy and the 84%Fe-1%Ti-15%Cr alloy according to the invention and the 88%Mn-12%Cu alloy of the prior art under annealed condition.

As seen from these graphs, the damping capacity of the alloy according to the invention is very high at room and high temperatures as compared with the Mn-Cu alloy. There is a tendency of the alloy according to the invention to increase the modulus of elasticity and tensile strength with the increase of the amount of the subingredients.

As can be seen from the above description, the alloy according to the invention can be very effectively used as damping alloy elements for the precision instruments susceptible to vibrations and the machines such as aircraft, ships, vehicles, and the like causing vibrations and noises.

The reason for the limitation of composition of the alloy according to the invention is as follows.

The at least one of tungsten, silicon and titanium is limited to 0.1–10% and iron to the remainder of the alloy because the damping capacity higher than $2\times10^{-3}$ aimed in the invention could not be obtained by alloys deviated from the limitation of the at least one of tungsten, silicon and titanium, and iron.

When the amount of at least one of tungsten, silicon and titanium is less than 0.1%, the damping capacity is not substantially improved as compared with that of the prior art, while when the amount is more than 10%, the damping capacity lowers. In order to provide an optimum damping capacity, the amount of at least one of tungsten, silicon and titanium is preferable within a range of 1–3%.

The high damping capacity aimed in the present invention can be accomplished by replacing a part of tungsten, silicon, titanium and iron of the alloy within 0.01–45% with any one or more of Cr, Al, Sb, Nb, V, Ta, Sn, Zn, Zr, Cd, Gd, Ga, P, Au, Ag, Ge, Sm, Se, Ce, La, Bi, Pt, Pd, Be, Mg, Re, Rh, Y, Pb, As, B, Eu and S.

Among the additional components, the addition of the element selected from Cr, V, Sn, Zn, Zr, Cd, Bi, Mg and Pb particularly improves the damping capacity of the Fe-W, Fe-Si and Fe-Ti binary alloys. Furthermore, the addition of the element selected from Cr, Nb, V, Ta, Zr, C, B and Y especially improves the tensile strength of the Fe-W, Fe-Si and Fe-Ti binary alloys.

In the ternary allows of Fe-W-Cr, Fe-Si-Cr, Fe-Ti-Cr, Fe-W-Au, Fe-Si-Au, Fe-Ti-Au, Fe-W-Ag, Fe-Si-Ag, Fe-Ti-Ag, Fe-W-Pt, Fe-Si-Pt, Fe-Ti-Pt, Fe-W-Pd, Fe-Si-Pd, Fe-Ti-Pd, Fe-W-Re, Fe-Si-Re, Fe-Ti-Re, Fe-W-Rh, Fe-Si-Rh, Fe-Ti-Rh, Fe-W-Y, Fe-Si-Y, Fe-Ti-Y, Fe-W-As, Fe-Si-As, Fe-Ti-As, Fe-W-Eu, Fe-Si-Eu and Fe-Ti-Eu according to the invention, Cr is limited to less than 45%, Au, Ag, Pt, Pd, Re, Rh or Y to less than 5%. As to less than 1% and Eu to less than 0.5% because alloys deviated from the above limitation could not accomplish the damping capacity higher than $2\times10^{-3}$ aimed in the invention.

Moreover, in the ternary alloys of Fe-W-Al, Fe-Si-Al, Fe-Ti-Al, Fe-W-Sb, Fe-Si-Sb, Fe-Ti-Sb, Fe-W-Nb, Fe-Si-Nb, Fe-Ti-Nb, Fe-W-V, Fe-Si-V, Fe-Ti-V, Fe-W-Ta, Fe-Si-Ta, Fe-Ti-Ta, Fe-W-Sn, Fe-Si-Sn, Fe-Ti-Sn, Fe-W-Zn, Fe-Si-Zn, Fe-Ti-Zn, Fe-W-Zr, Fe-Si-Zr, Fe-Ti-Zr, Fe-W-Cd, Fe-Si-Cd, Fe-Ti-Cd, Fe-W-Gd, Fe-Si-Gd, Fe-Ti-Gd, Fe-W-Ga, Fe-Si-Ga, Fe-Ti-Ga, Fe-W-P, Fe-Si-P, Fe-Ti-Ge, Fe-W-Sm, Fe-Si-Sm, Fe-Ti-Sm, Fe-W-Se, Fe-Si-Se, Fe-Ti-Se, Fe-W-Ce, Fe- Si-Ce, Fe-Ti-Ce, Fe-W-La, Fe-Si-La, Fe-Ti-La, Fe-W-Bi, Fe-Si-Bi, Fe-Ti-Bi, Fe-W-Be, Fe-Si-Be, Fe-Ti-Be, Fe-W-Mg, Fe-Si-Mg, Fe-Ti-Mg, Fe-W-Pb, Fe-Si-Pb, Fe-Ti-Pb, Fe-W-B, Fe-Si-B, Fe-Ti-B, Fe-W-S, Fe-Si-S and Fe-Ti-S according to the invention, Al, Sb, Nb, V, or Ta is limited to less than 10%, Sn, Zn, Zr, Cd, Gd, Ga, P, Ge, Sm, Se, Ce, La, Bi, Be or Mg to less than 5% and Pb or B to less than 1%, because alloys deviated from the above limitation did not exhibit the damping capacity higher than $2\times10^{-3}$ aimed in the present invention and the desired corrosion resistance.

| | Damping capacity | Anti-corrosion property | Mechanical strength | Workability |
|---|---|---|---|---|
| W | o | o | o | o |
| Si | o | o | o | o |
| Ti | o | o | o | o |
| Cr | o | o | o | o |
| Al | o | o | ⊕ | o |
| Sb | ⊕ | ⊕ | o | o |
| Nb | o | o | o | o |
| V | o | o | o | o |
| Ta | o | o | o | o |
| Sn | o | o | o | ⊕ |
| Zn | o | o | o | o |
| Zr | o | o | o | ⊕ |
| Cd | o | x | x | x |
| Gd | o | x | x | x |
| Ga | o | x | x | x |
| P | ⊕ | ⊕ | o | ⊕ |
| Au | o | o | x | o |
| Ag | o | o | x | o |
| Ge | o | x | x | x |
| Sm | o | x | x | x |
| Se | o | x | x | x |
| Ce | x | o | o | o |
| La | x | o | o | o |
| Bi | o | o | o | x |
| Pt | o | o | x | o |
| Pd | o | o | x | o |
| Be | o | o | o | x |
| Mg | x | o | o | o |

What is claimed is:

1. A high damping capacity alloy consisting essentially of from 0.1 to 10% by weight of either tungsten, silicon, and titanium or mixtures thereof, with the balance being essentially iron, and at least one additional ingredient in an amount of from 0.1 to 45% by weight, which ingredients fall in at least one of the following groups (A) through (E):

(A) up to 45% by weight of chromium, (B) up to 10% by weight of aluminum, antimony, niobium, vanadium or tantalum, (C) up to 5% by weight of silicon, tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, (D) up to 1% by weight of lead, arsenic and boron, (E) up to 0.5% by weight of europium and sulfur, having been formed into a shaped article at a temperature lower than 1,300° C. and said shaped article having been subjected to a heat treatment according to the following schedule:

(a) heating to a temperature of 800°–1600° C. but below its melting point for one minute to 100 hours to effect solution treatment, followed by:

(b) quenching at a rate quicker than 1° C./sec.

(c) cold working, and then (d) reheating to a temperature between 100° C. but lower than the temperature from which it was quenched, and then (e) slow cooling the same said treatment being effective to achieve a damping capacity of more than $2\times10^{-3}$ against vibration.

2. A high damping capacity alloy consisting of 0.1–10% by weight of at least one ingredient selected from a group consisting of tungsten, silicon and titanium, 0.01–45% by weight of chromium, and the remainder of iron as main ingredients, and further 0.01–45% by weight in total of sub-ingredients of at least one element selected from the group consisting of (A) up to 10% by weight of aluminum, antimony, niobium, vanadium or tantalum, (B) up to 5% by weight of tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, (C) up to 1% by weight of lead, arsenic and boron, and (D) up to 0.5% by weight of europium and sulfur, said alloy having been formed into a shaped article and said shaped article having been subjected to a heat treatment according to the following schedule:

(a) heating to a temperature of 800°–1600° C. but below its melting point for one minute to 100 hours to effect solution treatment, followed by:

(b) quenching at a rate quicker than 1° C./sec. followed by:

(c) cold working, and then (d) reheating to a temperature between 100° C., but lower than the temperature from which it was quenched, and then (e) slow cooling the same at a rate between 1° C./sec. and 1° C./hour, said treatment being effective to achieve a damping capacity of more than $2\times10^{-3}$ against vibration.

3. A process for producing a high damping capacity alloy consisting essentially of from 0.1 to 10% by weight of either tungsten, silicon, and titanium or mixtures thereof, with the balance being essentially iron, and at least one additional ingredient in an amount of from 0.01 to 45% by weight, which ingredient falls in at least one of the following groups (A) through (E):

(A) up to 45% by weight of chromium, (B) up to 10% by weight of aluminum, antimony, niobium, vanadium or tantalum, (C) up to 5% by weight of silicon, tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, (D) up to 1% by weight of lead, arsenic and boron, (E) up to 0.5% by weight of europium and sulfur, having been formed into a shaped article at a temperature lower than 1,300° C. and subjected to a heat treatment according to the following schedule:

(a) heating to a temperature of 800°–1600° C. but below its melting point for one minute to 100 hours to effect solution treatment, followed by:

(b) quenching at a rate quicker than 1° C./sec. followed by:

(c) cold working, and then (d) reheating to a temperature between 100° C. but lower than the temperature from which it was quenched, and then (e) slow cooling the same said treatment being effective to achieve a damping capacity of more than $2\times10^{-3}$ against vibration.

4. A process for producing a high damping capacity alloy consisting essentially of from 0.1 to 10% by weight of at least one selected from tungsten, silicon and titanium, from 0.01 to 45% by weight of chromium, and the balance being essentially iron, and 0.01 to 45% by weight in total of at least one additional ingredient which ingredient falls in at least one of the following groups (A) through (D):

(A) up to 10% by weight of aluminum, antimony, niobium, vanadium and tantalum, (B) up to 5% by weight of silicon, tin, zinc, zirconium, cadmium, gadolinium, gallium, phosphorus, gold, silver, germanium, samarium, selenium, cerium, lanthanum, bismuth, platinum, palladium, beryllium, magnesium, rhenium, rhodium and yttrium, (C) up to 1% by weight of lead, arsenic and boron, (D) up to 0.5% by weight of europium and sulfur, said alloy having been formed into a shaped article at a temperature lower than 1,300° C. and said shaped article having been subjected to a heat treatment according to the following schedule:

(a) heating to a temperature of 800°–1600° C. but below its melting point for one minute to 100 hours to effect solution treatment, followed by:

(b) quenching at a rate quicker than 1° C./sec. followed by:

(c) cold working, and then (d) reheating to a temperature between 100° C. but lower than the temperature from which it was quenched, and then (e) slow cooling the same at a rate between 1° C./sec. and 1° C./hour, said heat-treatment being effective to achieve a damping capacity of more than $2\times10^{-3}$ against vibration.

5. A high damping alloy as defined in claim 1, wherein the alloy consists essentially of from 0.1 to 10% by weight of either tungsten, silicon and titanium or mixtures thereof and the balance being essentially iron.

6. A process for producing a high damping capacity alloy as defined in claim 3, wherein the alloy consists essentially of from 0.1 to 10% by weight of either tungsten, silicon and titanium or mixtures thereof and the balance being essentially iron.

* * * * *